US006085391A

United States Patent [19]

Schäffler

[11] Patent Number: 6,085,391

[45] Date of Patent: Jul. 11, 2000

[54] MATTING DEVICE

[75] Inventor: Manfred Schäffler, Merching, Germany

[73] Assignee: Autefa Maschinenfabrik GmbH, Germany

[21] Appl. No.: 09/068,652

[22] PCT Filed: Nov. 22, 1996

[86] PCT No.: PCT/EP96/05154

§ 371 Date: May 6, 1998

§ 102(e) Date: May 6, 1998

[87] PCT Pub. No.: WO97/19209

PCT Pub. Date: May 29, 1997

[30] Foreign Application Priority Data

Nov. 23, 1995 [DE] Germany ..... 295 18 587 U

[51] Int. Cl.[7] ..... D04H 11/00

[52] U.S. Cl. ..... 19/163; 19/161.1; 19/296

[58] Field of Search ..... 19/161.1, 163, 19/296; 270/30.01, 30.05, 30.11, 30.13

[56] References Cited

U.S. PATENT DOCUMENTS 2,387,150 10/1945 Hlavaty .
3,877,628 4/1975 Asselin et al. .
4,830,351 5/1989 Stanislaw .

FOREIGN PATENT DOCUMENTS 0 517 568 12/1992 European Pat. Off. .
0 522 893 1/1993 European Pat. Off. .
0 609 907 8/1994 European Pat. Off. .
2 553 102 4/1985 France .
75059 6/1968 Germany .
1 927 863 12/1969 Germany .
24 29 106 1/1975 Germany .
WO 91/15618 10/1991 WIPO .

*Primary Examiner*—John J. Calvert
*Assistant Examiner*—Gary L. Welch
*Attorney, Agent, or Firm*—McGlew and Tuttle, P.C.

[57] ABSTRACT

The invention relates to a process for producing a nonwoven fabric and a matting device with several layering belts between which the web is taken up and guided at least in regions. The matting device has a belt inlet on the inlet side for the layering belts with an oblique downwards inclined inlet section with two belt sections running close to one another between which the web is led or covered on both sides. The width of the inlet section can be altered and can narrow like a funnel. The belt inlet can be mounted on the upper carriage so as to be either fixed or mobile.

25 Claims, 4 Drawing Sheets

MATTING DEVICE

FIELD OF THE INVENTION

The present invention pertains to a fleece folding machine with a plurality of carriages movable in relation to one another and a plurality of laying belts between which the nap is taken up and guided at least in some areas, wherein the fleece folding machine has a belt intake of the laying belts on the intake side for taking up the nap, and wherein the belt intake has an obliquely downwardly sloped intake section with two belt sections running adjacent to one another.

BACKGROUND OF THE INVENTION

Such a fleece folding machine has been known from FR-2 553 102. The fleece folding machine, designed as a so-called belt layer, has two main carriages movable relative to one another and two endless and rotatingly driven laying belts, which are guided in loops. The laying belts run in parallel at least in the section between the main carriages, and they take up and guide the nap between them. On the intake side, the fleece folding machine has a so-called belt intake of the laying belts for taking up the nap. The laying belts, moved on from two sides, meet here and form an intake section with an opening angle of the laying belts of at least 20°. The intake slot at the inlet of the intake section is very large as a result and is substantially wider than the nap thickness. The nap fed in on one of the laying belts is deflected obliquely downward against the horizontal at an acute angle in the belt intake. The nap lies open in the intake section due to the large opening angle and the wide intake slot and is clamped and guided on both sides between the laying belts only at the lower end between the two adjacent deflecting rollers. The nap may be lifted off from the lower laying belt in the intake section at high speeds. This may lead to disturbances, especially in sensitive naps. The feed speed is limited in this arrangement.

The nap fed on the laying belt is deflected downwards in the belt intake. In the belt intake, the two laying belts have two belt sections that run in parallel next to each other and in a straight line and form the said intake slot. These belt sections extend downwards at right angles in the state of the art, as a result of which the nap fed in horizontally is deflected by 90° at the belt intake. It was found in practice that such a belt intake can be used for limited nap feed speeds and work speeds of the fleece folding machine only. If the feed speeds become too high, tearing off may occur in the very light and highly sensitive fiber nap.

FR-2 553 102 shows another fleece folding machine. In the belt intake, the two laying belts have two straight belt sections running in parallel next to each other, which extend vertically downward, as a result of which the nap fed in horizontally is deflected by 90° at the belt intake. It was found in practice that such a belt intake can likewise be used for limited feed speeds of the nap and limited working speeds of the fleece folding machine only. If the feed speeds become too high, tearing off may occur in the very light and highly sensitive fiber nap.

Developments, e.g., according to EP-A-0 517 568, tend to provide a very broad and wide open intake hopper before the belt intake. The laying belt feeding in the nap has an obliquely falling belt section, on which nap is conveyed, however, open. The second laying belt comes in only at the lower end of the belt section, as a result of which the nap enters between the two laying belts at this point only and is taken up and guided bilaterally by the laying belts at the deflection of the belt only. The belt intake is arranged at the upper main carriage and consequently movably in this case as well.

WO 91/156018 shows another variant of the belt intake, in which both laying belts are guided via two large deflecting rollers at the main carriage. A wide intake hopper is also formed as a result for the nap fed in on the one laying belt. The two large deflecting rollers are arranged horizontally next to each other approximately at the same level, as a result of which the nap is taken up and guided on both sides by the laying belts coming close to each other here only approximately at the level of the center of the two rollers. Before and after this, the laying belts move apart due to the roller shape. Even though these above-mentioned two fleece folding machines are designed for higher nap feed speeds and work speeds of the fleece folding machine, speed-limiting problems nevertheless arise due to the fact that the laying belts are brought together in a punctiform or linear manner only and the guide length is correspondingly short.

Furthermore, fleece folding machines with stationarily arranged belt intakes, in which the laying belts are guided via stationarily arranged deflecting rollers, have been known from DE-A 19 27 863 and DE-A 24 29 106. Both fleece folding machines have horizontal belt intakes.

In DE-A 24 29 106, the two laying belts form a horizontal intake slot, which joins the feed belt coming from the card engine. The laying belts are separated from one another at the upper main carriage, the nap is deflected downwards by 90° and is conveyed and guided on the one lower laying belt only. In DE-A 19 27 863, the nap is fed in via a stationary conveyor belt arranged upstream and is brought in free fall onto a subjacent, somewhat obliquely extending laying belt section in front of the belt intake. The second laying belt is arranged only at a certain distance behind this point. The intake slot is formed only very late at the deflection point into the next horizontal intake section of the belt intake. Both embodiments with the stationary belt intake considerably limit the nap feed speed and the speed of the fleece folding machine.

SUMMARY AND OBJECTS OF THE INVENTION

The object of the present invention is to show a fleece folding machine with an improved belt intake.

The present invention accomplishes this object with first and second belts and a carriage receiving the first and second belts to form a belt intake and intake section for accumulating the nap. The belt intake and intake section are formed by two sections of the first and second belts running adjacent to one another and forming an intake slot. The intake section is adapted to a thickness of the nap, and the two belt sections run either substantially parallel to each other or at an acute angle to each other. The two belt sections both guide and cover opposite sides of the nap in the intake section.

The belt intake according to the present invention has an obliquely downwardly sloped intake section, which is formed by two belt sections running close to each other. On entry into the belt intake, the belt sections form a narrow intake slot between their adjacent deflecting rollers, which is adapted to the nap thickness. The two belt sections take up the nap fed in the next intake section and guide and/or cover it on both sides.

The belt sections are directed obliquely downward at an obtuse angle against the feed and intake direction. This offers the advantage that the nap is deflected more softly and the centrifugal forces acting do not become too strong. Due to the oblique position, the upper belt section can act as a cover for the nap at the deflection and prevent the nap from being lifted off by centrifugal forces, wind effects, etc. The belt intake according to the present invention ensures an especially gentle and reliable uptake of the nap. It makes possible substantially higher belt speeds and nap feed speeds, while preserving a high reliability of function and operation.

The belt sections are preferably straight and can run essentially in parallel over a certain section. As an alternative, an intake section tapering in a funnel-shaped manner is also possible. The nap can be optionally guided without compression in the intake section or be gradually compressed or clamped. The fast-moving nap is reliably grasped due to the funnel-shaped intake section and the air contained in it is squeezed out gently over a longer section and longer time period. Abrupt clamping points, rapid air flows and turbulence, which could damage or destroy the nap, are avoided. It is advantageous for the intake section to extend essentially in a straight line.

Due to the oblique intake section, the nap is taken up softly at the upper end and is deflected more sharply at the lower end only. It is advantageous to provide at least one belt loop at the lower deflection point. In an especially preferred embodiment, there are at least two belt loops, the first belt loop being arranged in front of the deflection point and the second belt loop behind it. Disturbing relative speeds of the laying belts and of their belt sections are prevented as a result at the critical deflection points. As a result, the nap can be deflected in an especially reliable and unloaded maimer. The nap is preferably clamped at three or more points in the deflection area by deflecting rollers.

Different possible settings are possible at the belt intake for adjustment to different conditions of use of the fleece folding machine, varying types of nap, etc. In particular, the width and optionally also the slope of the intake section can be varied. The adjustability of the distance between the laying belts makes possible an exact adaptation to the nap thickness and the setting of the frictional conditions necessary for conveying the nap. A preferred possibility of setting is the feeding of the different deflecting rollers or plate-like support means, depending on the design of the belt intake. However, other design variants are possible as well.

The belt intake may be stationary or mobile. It is located in front of or at the upper main carriage in the preferred exemplary embodiments.

The discharge section extending between the upper carriage and the laying carriage may also extend at an angle to the horizontal. This makes it possible to further reduce the deflection angle of the nap in the upper carriage and to reduce the centrifugal forces acting on the nap in the deflection area.

The laying belt that is the lower laying belt in the intake section may extend straight in a lead section in front of the intake. The nap is transferred from a feed belt onto this laying belt. As an alternative, the laying belt that is the lower laying belt in the intake section may also be designed as a feed belt at the same time. The lower laying belt may be deflected twice in this case to form the intake gap in front of the intake. If the lower laying belt is designed as a feed belt at the same time, some rollers and drives are eliminated, which leads to a less expensive design.

A pressing roller, preferably a screen or perforated roller, which is intended to remove air from the nap, may lie on the nap in front of the belt intake.

In an alternative exemplary embodiment, the feed section and the intake section may be located in a common plane. This plane is sloped downward by an angle toward the upper carriage relative to the horizontal. With such an intake zone, the nap is not deflected needlessly and can be fed straight to the upper carriage.

Additional advantageous embodiments of the present invention are described in the subclaims.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
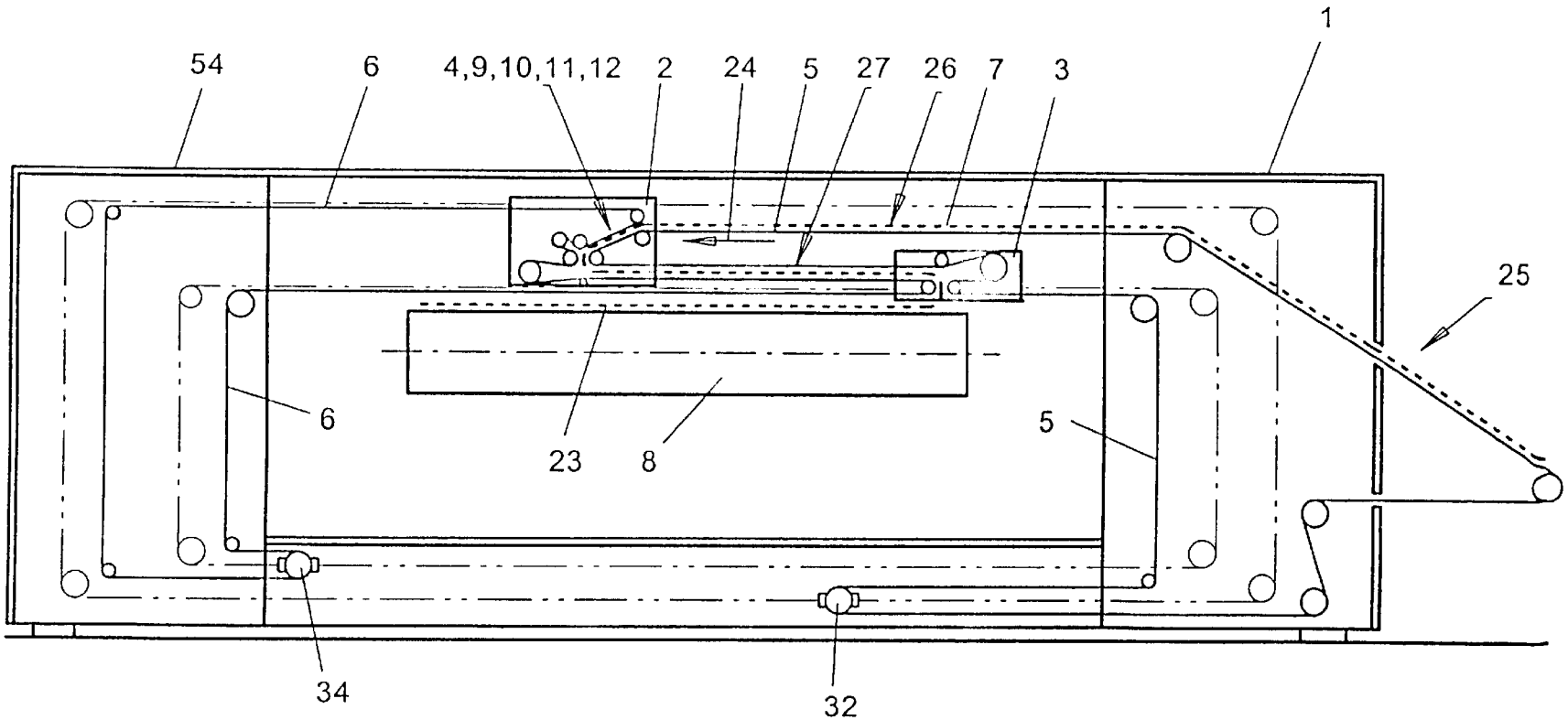
FIG. 1 is a synoptic view of a fleece folding machine with a moving belt intake at the laying carriage.
Figure 3:
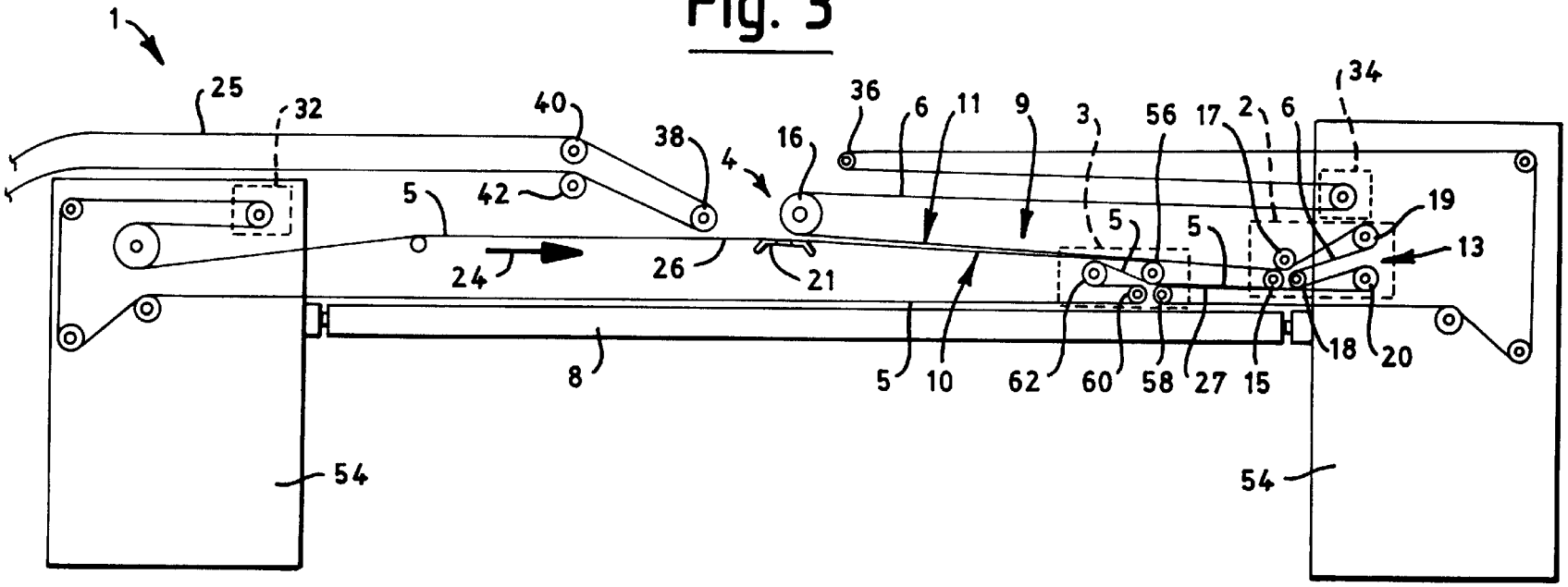
FIG. 3 is a synoptic view of a fleece folding machine as a variant to FIG. 1 with a stationary belt intake.

Referring to the drawings, and in particular to FIGS. 1 and 3, a fleece folding machine 1 is synoptically shown which is designed as a so-called belt layer. In a housing or frame 54, it has an upper main carriage 2 and a lower main carriage 3 and may also have one or more auxiliary carriages or tensioning carriages 32, 34. Two endless laying belts 5, 6 are guided over the carriages 2, 3, 32, 34 by means of suitable rollers. At least the two main carriages 2, 3 are driven by suitable drives, movably to and fro. The two laying belts 5, 6 are also rotatingly driven by means of suitable controllable and adjustable drives.

The fiber nap 7 produced by a nap maker (not shown), e.g., a card engine, enters the fleece folding machine 1 over a feed belt 25. It is guided over a feed section 26 either to, or at, the upper main carriage 2 and enters between the two laying belts 5, 6 at the belt intake 4, 9, which will be described in greater detail later. The laying belts are led in a loop in parallel to one another at least in the area between the two main carriages 2, 3 and they take up the nap 7 between them, convey it and guide it. This loop area is called the discharge section 27. It may extend horizontally or obliquely and connect the main carriages 2, 3 directly or via a deflection means (not shown), which is rigidly connected to the frame. The discharge section 27 advantageously extends in a straight line.

The nap 7 exits downward at the lower main carriage 3, the so-called laying carriage, and is laid down into a fleece 23 on an endless takeoff belt 8 running transversely. The laying carriage 3 moves to and fro over the takeoff belt 8, as a result of which the nap 7 is laid in a plurality of layers one on top of another at right angles and in a zigzag pattern to the delivery direction. The nap 7 is piled up in a scale-like pattern. The laying belts 5, 6 move apart again at the laying carriage 3 and are moved away to the outside in separate loops and then to the belt intake 9.

A great variety of possibilities, as they are known from, e.g., the prior art mentioned in the introduction to the specification, are available for the design embodiment and the function of the fleece folding machine 1. To form a short passage section, the two main carriages 2, 3 may move in the same direction, as in DE-A-19 27 863 or EP-A-0 517 568, or in opposite directions with stationary belt deflection, as in FR-A-2 553 102 or WO 91/156018. To influence the nap laying on the takeoff belt 8, internal stores may be formed by means of the auxiliary or tensioning carriages 32, 34. It is also possible to work with a draft during nap laying to set a defined thickness profile of the fleece 23.

Figure 2:
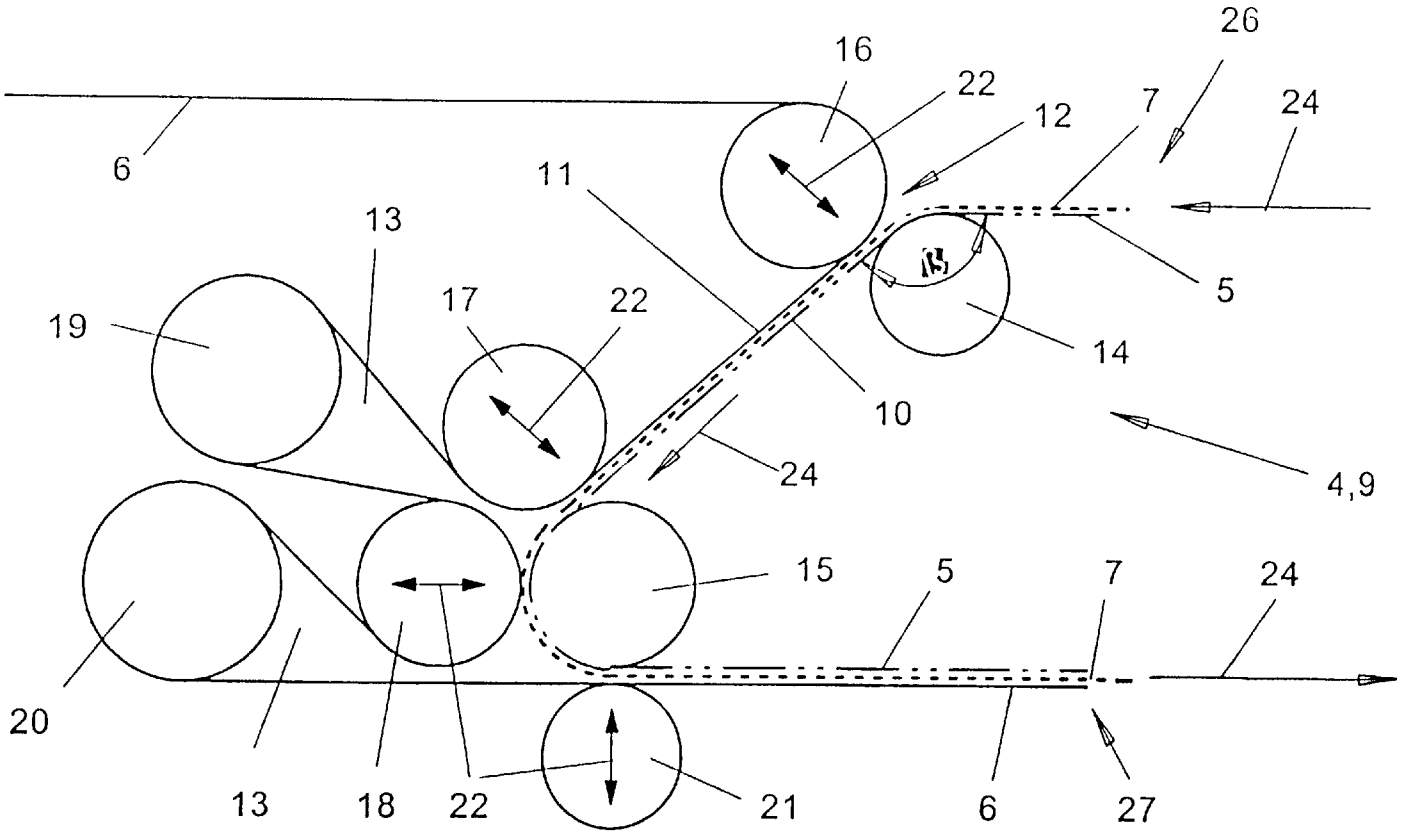
FIG. 2 is an enlarged and detailed partial view of the belt intake according to FIG. 1.

The belt intake 4 is mobile in the fleece folding machine according to FIGS. 1 and 2 and is located at the upper carriage 2. It has a comparatively short intake section 9 of a fixed length. FIGS. 3 through 6 show a variant with a stationary belt intake 4, which is arranged in front of the upper carriage 2. The intake section 9 is larger here and has a variable length.

FIG. 2 illustrates the belt intake 4 of the fleece folding machine 1 according to FIG. 1 in detail. The belt intake 4 is located at the upper main carriage 2 in this embodiment. The two laying belts 5, 6, which are again guided separately behind the laying carriage 3, meet at the belt intake 4, then run close to one another and take up the nap 7 fed in from the outside between them to form a closed belt intake section as shown in FIG. 2. One of the laying belts 5 is also used as a nap feed means 25 in the embodiment shown and is correspondingly led out of the housing 54 of the fleece folding machine 1. The nap 7 lies here open on the laying belt 5 and is conveyed by this to the belt intake 4.

The two laying belts 5, 6 are led together over deflecting rollers 14, 16 at the belt intake 4 to form a narrow intake slot 12. The deflecting rollers 14, 16 are joined by the intake section 9, which is formed by two belt sections 10, 11 of the laying belts 5, 6, which sections extend essentially straight, to another deflection 15. The belt sections 10, 11 take up the nap 7 between them and cover it and guide it on both sides along the intake section 9.

The intake slot 12 has an adjustable width, which can be adjusted to the particular requirements of the nap material. It is preferably somewhat larger than the nap thickness, so that the loose nap 7 can be taken up at first without forcing or compression. However, the width may be the same or smaller than the nap thickness and may optionally lead to a clamping already at the time of the entry of the nap 7 into the belt intake 4.

The belt sections 10, 11 extend essentially in parallel. This may be strictly parallel. However, as an alternative, the distance of the run may also decrease over the direction of run 24. An intake section 9 tapering at an acute angle in a funnel-shaped manner is formed as a result, in which the nap 7 is gradually compressed and clamped before it reaches the lower deflection 15. It may be favorable in this variant to set the width of the intake slot 12 larger than the nap thickness. However, it is also possible to clamp the nap 7 immediately at the time of entry into the belt intake 4 in the case of a small slot width and to further increase the compression over the length of the intake section 9. The selection of the suitable setting depends on the type of the nap material and possibly also on the nap feed speed and/or other parameters.

The intake section 9 and the belt sections 10, 11 forming same are sloped obliquely downward against the horizontal or the feed or intake direction 24 at an obtuse angle β. This obtuse angle β is related in FIG. 1 to the belt deflection of the laying belt 5 at the deflecting roller 14. The preferably horizontal feed section 26 of the laying belt 5 is deflected into the oblique belt section 10. The obtuse angle β between the belt sections is greater than 90° and smaller than 180°. It is preferably about 135°.

At the lower end of the intake section 9, the nap 7 and the laying belts 5, 6 are again deflected into a preferably horizontal direction and reach the laying carriage 3 via the discharge section 27. Thus, the nap 7 and the laying belts 5, 6 are deflected, on the whole, by 180° at the belt intake 4. Due to the oblique direction of the intake section 9, the deflection is smaller at its top end and greater at its lower end. The nap 7 is already fed securely over a rather long, straight section by the belt intake 4 before the lower, greater deflection 15 and is covered, and, as a result, it does not reach the clamping point at the deflection 15 suddenly.

The laying belt 5 is guided via two relatively stationarily arranged deflecting rollers 14, 15, which are preferably arranged at the upper main carriage 2. The deflecting rollers 14, 15 are spaced from one another vertically and horizontally corresponding to the oblique direction of the intake section 9.

The upper deflecting roller 16 of the other laying belt 6 is arranged above the opposite deflecting roller 14. The line connecting the two roller axes extends approximately at right angles to the slope of the intake section 9.

The laying belt 6 has two or more belt loops 13 at the lower end of the intake section 9. One of the belt loops 13 is located in front of the deflection point formed by the deflecting roller 15, and the second belt loop 13 is located behind it. The laying belt 6 located in the belt intake 9 on the top or on the outside is detached from the nap 7 via the belt loops 13 at the critical deflection points.

Different belt speeds are avoided in the area of the deflection due to the detachment, because the two laying belts 5, 6 move, with the nap between them, around the axis of the deflecting roller 15. The upper laying belt 6 would have to have a higher relative speed of travel to be able to guide the nap 7 without tension over the entire deflection area. However, the two laying belts 5, 6 have the same speed of travel. The two belt loops 13 eliminate the problem.

The first belt loop 13 is formed by deflecting rollers 17, 18, 19. The first deflecting roller 17 is seated at the lower end of the belt section 11 and is located above the deflecting roller 15. It is arranged such that the line connecting the axes of the two rollers is directed approximately at right angles to the slope of the intake slot 12. As a result, the laying belt 6 or its upper belt section 11 is separated from the nap 7 at approximately the same point at which the lower belt section 10 reaches the deflecting roller 15. As a result, the nap 7 enters the deflection area at the roller 15 without draft.

Via the deflecting roller 19, which is offset obliquely to the rear, the laying belt 6 is pulled out to the belt loop 13 and is then returned to the deflecting roller 18. The latter is located essentially at the same level as the deflecting roller 15 and has approximately the same diameter. As a result, the two laying belts 5, 6 meet again approximately at the level of the axes of the two rollers 15, 18 and can guide the nap 7 between them. They have essentially the same speed of travel, which is also equal to the speed of the nap.

The second belt loop 13, which is pulled out by a laterally offset deflecting roller 20, is seated behind the deflecting roller 18. Its diameter is selected to be such that the laying belt 6 is subsequently deflected into a horizontal section extending in parallel to the laying belt 5. The two laying belts 5, 6 are again so close to one another in this next section that they guide the nap 7 between them on both sides.

A support means, e.g., a support roller 21 for the laying belt 6, may be arranged under the deflecting roller 15. The support roller 21 influences the distance between the laying belts 5, 6.

The nap 7 is squeezed or clamped by the roller arrangement shown in the area of the lower deflection at the deflecting roller 15 at three points between the laying belts 5, 6 and is as a result guided reliably and at the same belt speeds. At the end of the intake section 9, the guiding between the belt sections 10, 11 is just long enough to reach the lower deflecting roller 15. Bilateral guiding takes place thereafter approximately at the level of the axes of the deflecting rollers 15, 18. The third guiding point is located at the end of the deflection between the deflecting roller 15 and the support roller 21, which is preferably located perpendicularly under it. The laying belt 5 again leaves the deflecting roller 15 at this point.

The belt intake 4 and the intake section 9 are adjustable. For example, the position of the deflecting rollers 16, 17, 18 and the support roller 21 can be changed with suitable feed means 22. The direction of feed is preferably at right angles to the direction of the intake section 9 in the case of the deflecting rollers 16, 17 located in the area of the intake slot 12. The width of the intake slot 12 and optionally also the funnel-shaped narrowing of the intake section 9 can be changed as a result. The laying belts 5, 6 may be permeable to air, so that the nap is compressed due to the increasing tapering of the intake section 9 and the air contained in it is squeezed out in the process.

The deflecting roller 18 is preferably adjustable horizontally and, as a result, it can be brought closer to or moved away from the deflecting roller 15 of the laying belt 5. The second guiding point for the nap 7 in the lower deflection area is influenced by this.

The support roller 21 is vertically adjustable and it can also be brought closer to or moved away from the deflecting roller 15 as a result. The nap guiding is influenced with the support roller 21 at the third guiding point.

The direction of travel of the nap 7 and of the laying belt 5 feeding it in the area of the belt intake 9 is marked by arrows 24.

Modifications of the embodiment shown are possible in various ways. In the exemplary embodiment shown, the two belt sections 10, 11 taking up the nap 7 begin at approximately the same level at the inlet of the intake slot 12. As an alternative, the upper belt section 11 may also be arranged somewhat higher and it may optionally project over the deflection point at the roller 14. This is favorable, e.g., for catching a very fast-moving nap. However, the belt section 11 may also be arranged somewhat lower. The design, number and arrangement of the belt loops 13 at the lower end of the intake section 9 are variable as well. It is possible, e.g., to have only the one, lower belt loop 13. The possibilities of adjusting and feeding the individual deflecting rollers or other belt-guiding parts at the belt intake 4 are also variable. The intake section 9 may also be slightly curved.

In the alternative exemplary embodiment shown in FIG. 3, the fleece folding machine 1 has a separate feed belt 25, via which the nap 7 is fed from a card engine arranged in front of it at a uniform, but variable speed. The fleece folding machine 1 is again equipped with four carriages, namely, with an upper carriage 2, a laying carriage 3 and one tensioning carriage 32, 34 each for each laying belt 5, 6.

The first laying belt 5 takes over the nap 7 from the feed belt 25 in the area of the feed section 26 and guides the nap 7 into a stationary belt intake 4 between the two laying belts 5, 6, which extends to the upper carriage 2 and to the deflection 15 located there. The stationary belt intake 4 is arranged in the vicinity of the end of the path of movement of the upper carriage 2 approximately in the middle of the laying width of the fleece folding machine 1. The laying belt 5 is fed to the belt intake 4 as a lower laying belt, while the upper laying belt 6 is fed in via a deflecting roller 16.

The stationarily mounted deflecting roller 16 has a diameter that is substantially larger than that of the other deflecting rollers, as a result of which an intake hopper is formed at the belt intake 4. The distance between the laying belts 5, 6 at the belt intake 4 is, e.g., greater than the nap thickness. The intake slot 12 thus formed makes possible the intake of the nap 7 on the belt at first without an essential clamping or compression. A height-adjustable support means 21, with which the gap width of the intake slot 12 can be set, is located under the lower laying belt 5.

Between the intake slot 12 and the upper carriage 2 extends the essentially straight intake section 9, in which the belt sections 10, 11 of the laying belts 5, 6 gradually move toward each other, so that the distance between them will be adapted to the nap thickness at the latest at the end of the intake section 9 at the upper carriage 2. This distance may correspond, e.g., to the nap thickness or it may be set at a fixed value, e.g., 15 mm. The nap 7 is gradually guided on both sides and covered in the intake section 9 tapering in a funnel-shaped manner. This may happen without compression. As an alternative, the nap 7 may also be gradually compressed and clamped in the intake section 9. The intake section 9 changes its length with the movement of the upper carriage 2.

As in the above-described exemplary embodiment, the upper laying belt 6 is deflected several times in the upper carriage 2 over a guide roller 17 and over the rollers 18, 19, 20, forming two belt loops 13, so that the nap 7 does not run between the two laying belts 5, 6 in the deflection area of the upper carriage 2. The nap 7 is again guided between the two laying belts 5, 6 only under the deflecting roller 15 for the lower laying belt 5. The laying belts 5, 6 may be supported at the roller 56 of the laying carriage 3.

The discharge section 27 extending between the upper carriage 2 and the laying carriage 3 preferably extends in a straight line, and, after another deflection by 90° in the laying carriage 3, the nap 7 is discharged at a discharge point and is laid by the laying carriage 3 performing alternating movements on the takeoff belt 8. The laying carriage 3 also has a guide roller 56 for the laying belt 5, which is again returned to the belt intake 4 via additional deflecting rollers after being deflected twice over the deflecting rollers 60, 62. The laying belt 6 is deflected over a deflecting roller 58 and is returned to the belt intake 4.

The intake section 9 and/or the discharge section 27 preferably extend obliquely downward at an obtuse angle $\beta$ to the horizontal in the direction of movement 24 of the laying belts 5, 6. As in the first exemplary embodiment in FIGS. 1 and 2, this angle is between 90° and 180° and equals, e.g., about 170°.

A tensioning carriage 32, which is controlled as a function of the movement of the laying carriage 3, is provided for the laying belt 5. A tensioning carriage 34, which is controlled as a function of the movement of the upper carriage 2 and of the laying carriage 3, is provided for the laying belt 6. The movement of the tensioning carriage 34 is restrictedly guided by means of toothed belts.

The tensioning carriage 34 is arranged behind a stationary deflecting roller 36 and the additional, stationary deflecting roller 16 at the belt intake 4 in the direction of travel of the laying belt 6.

Figure 4:
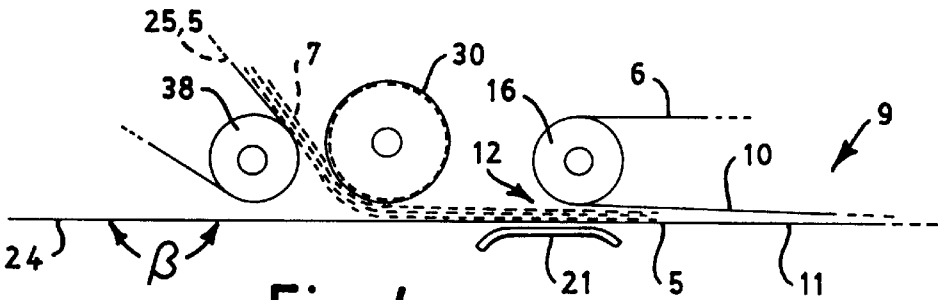
FIG. 4 is a detail of the belt intake from FIG. 3 with a pressing roller arranged in front of it.

FIG. 4 shows the belt intake 4 on a larger scale, wherein a pressing roller 30 comprising a perforated or screen roller can precompress the nap 7 before the intake slot 12. The pressing roller 30 may be held at a predetermined distance from the lower laying belt 5.

Figure 5:
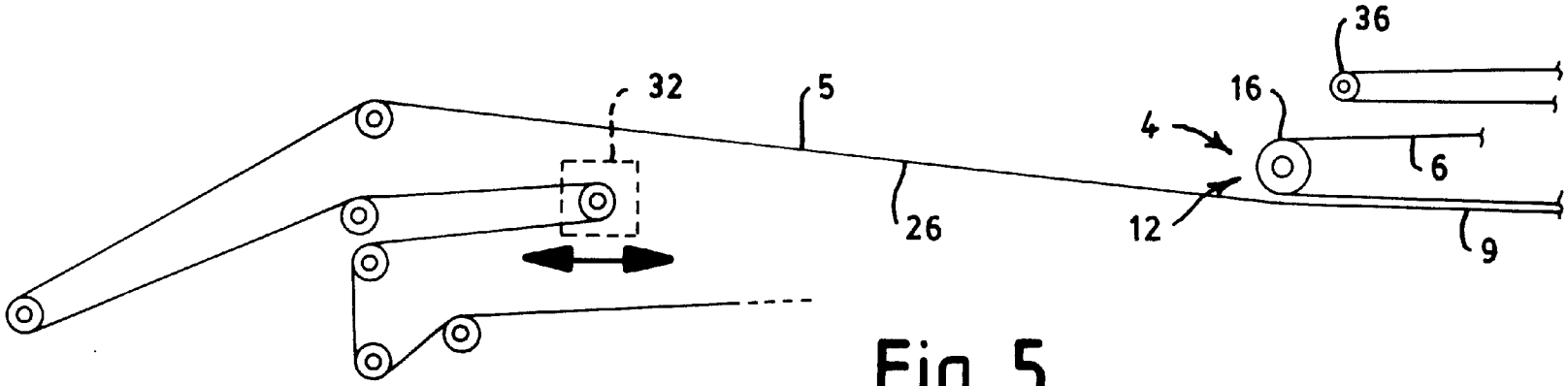
FIG. 5 is an alternative exemplary embodiment of the belt intake from FIG. 4, in which the lower laying belt is also the feed belt.

FIG. 5 shows an alternative exemplary embodiment, in which the laying belt 5 that is the lower laying belt in the intake section 9 is also used as a feed belt 25 at the same time. A feed section 26 located in front of the lead section 9 before the belt intake 4 is located in the same plane as the intake section 9 and is sloped downward relative to the horizontal in the direction of movement of the laying belt 5. The nap 7 is no longer deflected in this exemplary embodiment in the feed zone and in the intake section 9 up to the upper carriage 2.

Figure 6:
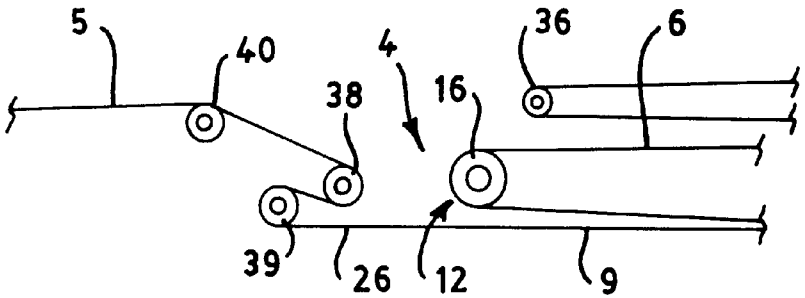
FIG. 6 is another alternative exemplary embodiment for FIGS. 4 and 5, in which the lower laying belt is also the feed belt.

FIG. 6 shows another exemplary embodiment, in which the lower laying belt 5 is also used as a feed belt 25 at the same time. The laying belt 5 is deflected several times over the deflecting rollers 38 through 40, so that the laying belt 5 can be fed to the intake section 9 at a spaced location from the laying belt 6 to form the intake slot 12. Instead of the support means 21, the deflecting roller 39 may be adjustable in height in this case.

The features described in specification, drawings, abstract, and claims, can be used individually and in arbitrary combinations for practicing the present invention.

While specific embodiments of the invention have been shown and described in detail to illustrate the application of the principles of the invention, it will be understood that the invention may be embodied otherwise without departing from such principles.

APPENDIX

List of Reference Numbers

1 Fleece folding machine
2 Main carriage, upper carriage
3 Main carriage, laying carriage
4 Belt intake
5 Laying belt, feed belt
6 Laying belt, opposite belt
7 Nap
8 Takeoff belt
9 Intake section
10 Belt section
11 Belt section
12 Intake slot, intake hopper
13 Belt loop
14 Deflecting roller, feed belt
15 Deflecting roller, feed belt
16 Deflecting roller, opposite belt
17 Deflecting roller, opposite belt
18 Deflecting roller, opposite belt
19 Deflecting roller, belt loop
20 Deflecting roller, belt loop
21 Support means, support roller
22 Feed means
23 Fleece
24 Direction of travel
25 Feed belt
26 Feed section
27 Discharge section
30 Pressing roller
32 Tensioning carriage, auxiliary carriage
34 Tensioning carriage, auxiliary carriage
36 Deflecting roller
38 Deflecting roller
39 Deflecting roller
40 Deflecting roller
42 Deflecting roller
54 Frame
56 Guide roller
58 Deflecting roller
60 Deflecting roller
62 Deflecting roller

What is claimed is:

1. A fleece folding machine comprising:

first and second belts;

a carriage receiving said first and second belts to form a belt intake and intake section for accumulating nap, said belt intake and intake section being formed by two sections of said first and second belts running adjacent to one another and forming an intake slot, said intake section being adapted to a thickness of the nap, said two belt sections running in one of substantially parallel to each other and running at an acute angle to each other, said two belt sections both guiding and covering opposite sides of the nap in said intake section, each of said two sections of said first and second belts forming said intake section are substantially straight, said carriage includes a belt deflection, said intake section tapers in a funnel-shaped manner for compressing the nap and clamping the nap in said intake section before reaching an end of said intake section.

2. A machine in accordance with claim 1, wherein:

said belt deflection is positioned at an end of said intake section.

3. A machine in accordance with claim 1, wherein:

one of said intake section and said intake slot have means for adjusting a width of said intake section and intake slot respectively.

4. A machine in accordance with claim 1, wherein:

a width of said intake slot is greater than said nap thickness.

5. A machine in accordance with claim 1, wherein:

said intake section guides the nap without compression.

6. A machine in accordance with claim 1, wherein:

said intake section guides the nap with increasing compression.

7. A machine in accordance with claim 1, wherein:

another carriage is positioned downstream of said carriage and receives said first and second belts from said carriage, said carriage and said another carriage being movable in relation to one another, said belt intake is arranged stationary in front of said carriage.

8. A machine in accordance with claim 1, wherein:

said two belt sections extend in a substantially straight line.

9. A machine in accordance with claim 1, wherein:

another carriage is positioned downstream of said carriage and receives said first and second belts from said carriage, said carriage and said another carriage being movable in relation to one another;

said first and second belts form a discharge section between said carriage and said another carriage;

one of said intake section and said discharge section are directed obliquely downward at an obtuse angle with respect to horizontal and a direction of feed.

10. A machine in accordance with claim 1, wherein:

said first belt forms a feed belt means for conveying the nap to said belt intake.

11. A machine in accordance with claim 1, wherein:

said carriage includes an upstream belt deflection means for deflecting said second belt into said belt intake;

said two belt sections begin at said upstream belt deflection at substantially a same level.

12. A machine in accordance with claim 1, wherein:

said carriage includes means for moving one of said belt sections to adjust a width of one of said belt intake and said intake section.

13. A machine in accordance with claim 1, wherein:

said carriage includes a plurality of deflecting rollers arranged at ends of said belt sections.

14. A machine in accordance with claim 13, wherein:

two of said deflecting rollers are located substantially horizontally opposite each other at a downstream end of said intake section, an upper of said two belt sections includes a belt loop at a downstream end of said intake section before one of said deflecting rollers.

15. A machine in accordance with claim 13, wherein:

a support means is arranged under a lower said deflecting roller of said first belt.

16. A machine in accordance with claim 15, wherein:

one of said deflecting rollers and said support means have a feed means for adjusting a position of said one of said deflecting rollers and said support means with respect to another of said one of said deflecting rollers and said support means.

17. A machine in accordance with claim 1, wherein:

an upper of said two belt sections includes a belt loop at a downstream end of said intake section.

18. A machine in accordance with claim 1, wherein:

a pressing roller is arranged upstream of said belt intake, said pressing roller pressing on the nap.

19. A machine in accordance with claim 18, wherein:

said pressing roller is a screen roller.

20. A machine in accordance with claim 1, wherein:

another carriage is positioned downstream of said carriage and receives said first and second belts from said carriage, said carriage and said another carriage being movable in relation to one another;

said intake section is sloped obliquely downward.

21. A machine in accordance with claim 1, wherein:

each of said two sections of said first and second belts forming said intake section are formed by separate roller pairs, individual rollers in said each roller pair being spaced from each other;

said intake section is an elongated substantially straight section;

said two sections of said first and second belts forming said intake section are positioned to contact opposite sides of the nap;

said two sections of said first and second belts forming said intake section are positioned to form a closed belt intake.

22. A process for preparing a fleece from nap, the process comprising the steps of:

providing first and second belts;

providing a first carriage receiving said first and second belts and forming a belt intake leading into an intake section with two sections of said belts, said two sections of said belts being one of substantially parallel and at an acute angle to each other, each of said two sections of said first and second belts forming said intake section are substantially straight;

conveying the nap between said two sections of belt in said intake section to successively remove air from the nap;

moving said first carriage forward and backward in a direction of the nap arriving to said first carriage;

providing a second carriage positioned downstream from said first carriage and receiving said first and second belts from said first carriage;

providing a takeoff means for receiving the nap from said belts, said takeoff means having a layering width;

laying the nap on said takeoff means by moving said second carriage back and forth across said layering width;

deflecting said first belt in said first carriage;

running said second belt in a belt loop adjacent said deflecting of said first belt.

23. A process in accordance with claim 22, wherein:

a distance between said first and second belt sections at a downstream end of said intake section is adapted to a thickness of the nap.

24. A process in accordance with claim 22, wherein:

a distance between said first and second belt sections at a downstream end of said intake section is reduced to a thickness of the nap.

25. A fleece folding machine comprising:

first and second belts;

a carriage receiving said first and second belts to form a belt intake and intake section for accumulating nap, said belt intake and intake section being formed by two sections of said first and second belts running adjacent to one another and forming an intake slot, said intake section being adapted to a thickness of the nap, said two belt sections running in one of substantially parallel to each other and running at an acute angle to each other, said two belt sections both guiding and covering opposite sides of the nap in said intake section, each of said two sections of said first and second belts forming said intake section are substantially straight;

another carriage positioned downstream of said carriage and receiving said first and second belts from said carriage, said carriage and said another carriage being movable in relation to one another.

* * * * *